United States Patent [19]

Toda et al.

[11] Patent Number: 4,945,325

[45] Date of Patent: Jul. 31, 1990

[54] CIRCUIT BREAKER WITH SMOOTH SLIDING OPERATION

[75] Inventors: Haruhisa Toda; Hiroaki Fujihisa; Shiro Murata, all of Hiroshima, Japan

[73] Assignee: Mitsubishi Denki Kabushiki Kaisha, Tokyo, Japan

[21] Appl. No.: 272,329

[22] Filed: Nov. 17, 1988

[30] Foreign Application Priority Data

Nov. 20, 1987 [JP] Japan ..... 62-177948[U]
Nov. 20, 1987 [JP] Japan ..... 62-177949[U]
Nov. 20, 1987 [JP] Japan ..... 62-177950[U]

[51] Int. Cl.[5] ..... H01H 75/00
[52] U.S. Cl. ..... 335/16; 335/6
[58] Field of Search ..... 335/6, 16, 147, 195; 200/147 R

[56] References Cited

U.S. PATENT DOCUMENTS 4,635,014 1/1987 Erb et al. ..... 335/195
4,745,384 5/1988 Toda et al. ..... 335/190

*Primary Examiner*—Leo P. Picard
*Assistant Examiner*—Lincoln Donovan
*Attorney, Agent, or Firm*—Burns, Doane, Swecker & Mathis

[57] ABSTRACT

A circuit breaker wherein at least a pin sliding surface of a guide hole of a first contact arm, at least a pin sliding surface of a long hole of a second contact arm, and at least a contact surface of a second pin in contact with both the pin sliding surfaces, are treated by low-friction treatment to reduce frictional resistance, and surface-treated to provide surfaces exempt from attachment of molten metal caused by arcing; and furthermore at least the pin sliding surface of the first contact arm and at least the pin sliding surface of the long hole of the second contact arm are hardened to provide both the pin sliding surfaces with greater hardness than the second pin, thereby ensuring smooth movement of the second pin.

3 Claims, 10 Drawing Sheets

CIRCUIT BREAKER WITH SMOOTH SLIDING OPERATION

BACKGROUND OF THE INVENTION

1. Field of the Invention

The present invention relates to a circuit breaker designed to limit the current by actuating a movable contact with an electromagnetic repulsion resulting from the flow of high currents regardless of the tripping operation of an automatic tripping device.

2. Description of the Related Art

In general, circuit breakers of the above-described design are known in the technical field of prior art. Construction and operation of a typical circuit breaker will now be described with reference to FIGS. 1 through 6.

FIG. 1 a longitudinal sectional side view of the circuit breaker; FIG. 2 is an enlarged view of a major part of the breaker shown in FIG. 1 showing the ON state; FIG. 3 is the same view as FIG. 2 showing the OFF state; FIG. 4 is the same view as FIG. 2 showing the TRIP state; FIG. 5 is the same view as FIG. 2 showing the REPULSION state; and FIG. 6 is a partly longitudinal enlarged view of FIG. 5. In FIGS. 1 through 6, reference numeral 1 is a circuit breaker case. The circuit breaker case comprises a base 1*a* and a cover 1*b*. 2 is a fixed conductor on the power supply side securely mounted on the base 1*a;* 3 designates a fixed contact fixedly attached to the fixed conductor 2; 4 is an automatic tripping device; 5 indicates a fixed conductor on the load side connected to the automatic tripping device 4; 6 is a movable contact; 7 represents a movable contact arm on which the movable contact 6 is fixed attached; 8 designates a flexible conductor for connecting the movable contact arm 7 to the automatic tripping device 4 via a connecting conductor 9; and 10 designates a contact arm holding the movable contact arm 7, which is divided into a first contact arm 10*a* connected with a switching mechanism (will be described later) and a second contact arm 10*b* rotatably supporting the movable contact arm 7 by a first pin 11. 12 indicates a support shaft of the contact arm 10, which rotatably supports the first contact arm 10*a* and the second contact arm 10*b*. 13 indicates a cross bar connecting the first contact arm 10*a* of each pole; 14 designates a guide hole provided in the first contact arm 10*a* and extending toward opening and closing the contacts; and 15 designates a long hole provided in the second contact arm 10*b* and extending in the direction intersecting the guide hole 14. 16 is a second pin fitted in both the guide hole 14 and the long hole 15; and 17 designates a tension spring provided between the first pin 11 and the second pin 16, constantly pulling the second pin 16. 18 is a contact pressure spring provided between the movable contact arm 7 and the second contact arm 10*b;* 19 designates a circuit breaker operating handle; and 20 represents a circuit breaker switching mechanism comprising a cradle 20*a*, an upper link 20*b* and a lower link 20*c*. 21 designates a stopper pin provided on the cradle 20*a;* 22 is a connecting pin for connecting the lower link 20*c* to the first contact arm 10*a;* and 23 indicates an arc-extinguishing chamber.

Next, the operation of this circuit breaker will be explained. In the ON state shown in FIGS. 1 and 2, the current flows in the direction of the fixed conductor 2 on the power supply side, the fixed contact 3, the movable contact 6, the movable contact arm 7, the flexible conductor 8, the connecting conductor 9, the automatic tripping device 4 and the fixed conductor 5 on the load side in order of mention. When the operating handle 19 is operated to the OFF position (in the direction of the arrow 24 in FIG. 2), the contact arm 10 is raised by the switching mechanism 20, thus moving the movable contact 6 together with the movable contact arm 7 away from the fixed contact 3 as shown in FIG. 3. At this time, as the second pin 16 is held in a recess 14*a* of the guide hole 14 by the tension spring 17, the second contact arm 10*b* is raised together with the first contact arm 10*a* by the switching mechanism 20, turning on the center of a support shaft 12 up until it hits a stopper pin 21 and stops.

When an overload current flows in the ON state shown in FIGS. 1 and 2, the automatic tripping device 4 operates to turn the cradle 20*a* in the direction of the arrow 25 in FIG. 2 and the switching mechanism 20 operates to raise the contact arm 10, thus opening the movable contact 6 to interrupt the overload current as shown in FIG. 4. That is, the device comes in a so-called "trip state". As the second pin 16 is held in the recess 14*a* of the guide hole 14 by the tension spring 17 as in the case of the OFF state in FIG. 3, the second contact arm 10*b*, together with the first contact arm 10*a*, is raised by the switching mechanism 20, turning on the center of the support shaft 12 until it hits against the stopper pin 21 and stops.

If a high current, such as a short-circuit current, flows in the ON state shown in FIGS. 1 and 2, the movable contact arm 7 repulses the fixed conductor 2 by the action of an electromagnetic force produced between the fixed conductor 2 and the movable contact arm 7, opening the contacts as shown in FIG. 5. At this time, as the operation of the first contact arm 10*a* actuated by the switching mechanism 20 which operates in succession to the operation of the automatic tripping device 4 delays in time, the second contact arm 10*b* overcomes the force of the tension spring 17, releasing the second pin 16 from the recess 14*a*. Therefore the second pin 16 will move along the guide hole 14, allowing the second contact arm 10*b* to turn on the center of the support shaft 12 to open in the direction of a third arrow 26. The second pin 16, therefore, will hit against the end 14*b* of the guide hole 14 and stop. This repulsive motion is faster than the operation of the switching mechanism 20 to which the movable contact arm 7 is connected through the contact arm 10, thereby enhancing the current limiting effect. The first contact arm 10*a* is tripped by the automatic tripping device 4 successively to the repulsive state in FIG. 5 and raised, and therefore the second pin 16 will go again into the recess 14*a* of the guide hole 14, presenting the trip state shown in FIG. 4. This operation is called as "the reset of the contact arm 10". At this time, the second pin 16, being pulled by the tension spring 17, makes one reciprocating motion on the pin slide surface 15*a* of the long hole 15 with its contact surface 16*a* in contact with the pin sliding surface 15*c* of the guide hole 14.

In conventional circuit breakers described above, the first contact arm 10*a*, the second contact arm 10*b* and the second pin 16 are plated for rust prevention or produced of stainless metals. Accordingly, there occurs a great deal of frictional resistance between the contact surface 16*a* of the second pin and both the sliding surfaces 14*c* and 15*a* (see FIG. 2) when the second pin 16 slides in the guide hole 14 and the long hole 15, resulting in a decrease in the operating speed. Therefore, there is such a problem that a lowered circuit breaker performance results, and a considerable force will be required for resetting after the breaking of circuit.

The present invention has been accomplished in an attempt to solve the above-described problem, and accordingly, it is a first object of the present invention to provide a circuit breaker having an improved performance obtained by increasing its operating speed through the reduction of the frictional resistance between both the pin sliding surfaces of the guide hole and the long hole and the contact surface of the second pin and also a decreased resetting load after circuit interrupting.

Furthermore, in the conventional circuit breakers, the first contact arm 10*a*, the second contact arm 10*b* and the second pin 16 are galvanized for rust prevention purposes. There, however, is such a problem that, because of its low melting temperature, zinc used in this galvanizing melts, allowing such molten metals as molten copper and silver alloy to hold on the pin sliding surface 14*c* of the guide hole 14, the pin sliding surface 15*a* of the long hole 15, and the contact surface 16*a* of the second pin 16, and accordingly resulting in poor movement of the second pin 16 and a failure in obtaining a stabilized circuit breaking performance.

The present invention has been accomplished to solve this problem, and therefore it is a second object of the present invention to provide a circuit breaker capable of preventing the poor movement of the second pin and, accordingly, obtaining a stabilized circuit breaking performance by preventing arc-molten metals from attaching on both the pin sliding surfaces of the guide hole and the long hole and the contact surface of the second pin.

In the conventional circuit breakers described above, since the second pin 16 is engaged with both the guide hole of the first contact arm 10*a* and the long hole 15 of the second contact arm 10*b* (see FIG. 6), the pin sliding surface 14*c* of the guide hole 14 and the pin sliding surface 15*a* of the long hole 15 receive an impact force of the second pin 16 when the circuit breaker opens and closes. Because of an occurrence of this impact force, the second pin 16 will make a dent in both the pin sliding surfaces 14*c* and 15*a*, resulting in unsmooth movement of the second pin 16 itself and accordingly, in unstable circuit breaking performance.

The present invention has also been accomplished in an attempt to solve the above-described problem, and therefore has a third object to provide a circuit breaker having a stabilized circuit breaking performance without the formation of dents in both the pin sliding surfaces of the guide hole and the long hole by the second pin and accordingly, without the unsmooth movement of the second pin.

SUMMARY OF THE INVENTION

The above-described objects of the present invention are accomplished by providing a first circuit breaker wherein at least the pin sliding surface of the guide hole of the first contact arm, at least the pin sliding surface of the long hole of the second contact arm, and at least the contact surface of the second pin in contact with both the pin sliding surfaces, are surface treated to afford low frictional properties.

In the first circuit breaker of the present invention, both the pin sliding surfaces of the guide hole and the long hole and the second pin contact surface are surface-treated to provide low frictional properties. Both the pin sliding surfaces and the pin contact surfaces, therefore, have little frictional resistance.

Furthermore, a second circuit breaker according to the present invention is characterized in that at least the pin sliding surface of the guide hole of the first contact arm, at least the pin sliding surface of the second contact arm, and at least the contact surface of the second pin which contacts both the pin sliding surfaces, are surface-treated to form surfaces exempt from attachment of molten metals caused by arcing.

Furthermore, in this second circuit breaker, both the pin sliding surfaces of the guide hole and the long hole, and the contact surface of the second pin are surface-treated to form a surface exempt from attachment of arc-molten metals. Therefore, both the sliding surfaces and the contact surface are not subject to attachment of arc-molten metals at the time of opening of the circuit breaker contacts, thereby insuring smooth movement of the second pin.

Moreover, a third circuit breaker according to the present invention is characterized in that at least the pin sliding surfaces of the guide hole of the first contact arm and the long hole of the contact arm are hardened by surface-treatment, thereby increasing the hardness of both the pin sliding surfaces more than that of the second pin.

Furthermore, in this circuit breaker, both the pin sliding surfaces of the guide hole and the long hole are hardened by a surface-hardening treatment, increasing the hardness of both these pin sliding surfaces over that of the second pin. These pin sliding surfaces, therefore, will not be subjected to indentation resulting from the impact of the second pin caused by the opening and closing operation of the circuit breaker contacts, thus insuring smooth movement of the second pin.

BRIEF DESCRIPTION OF THE DRAWINGS

The present invention is best understood with reference to the specification in conjunction with the accompanying drawings in which.

DETAILED DESCRIPTION OF THE PREFERRED EMBODIMENTS

Construction of First Circuit Breaker

Figure 7:
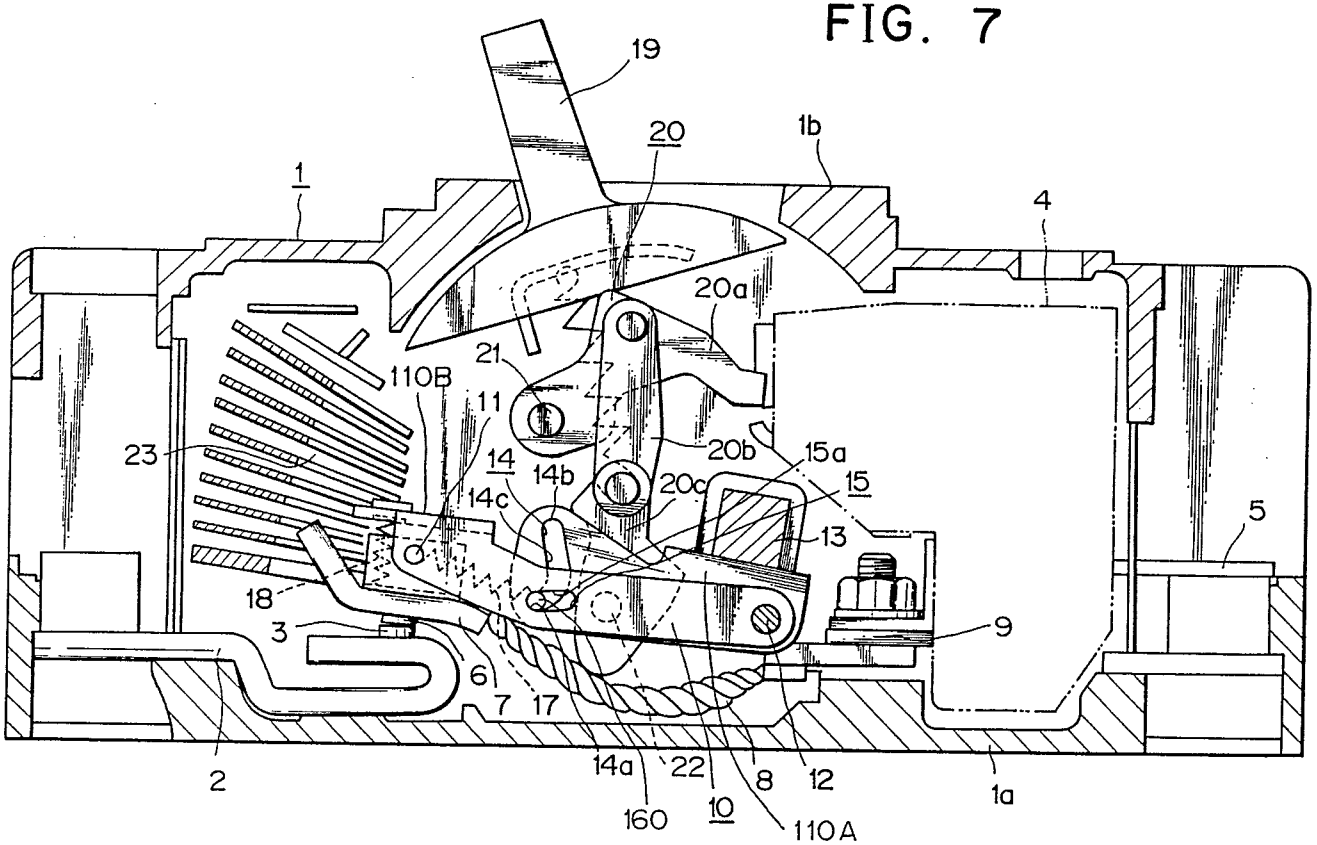
FIG. 7 is a cross-sectional view of a circuit breaker according to a first preferred embodiment of the invention.
Figure 8:
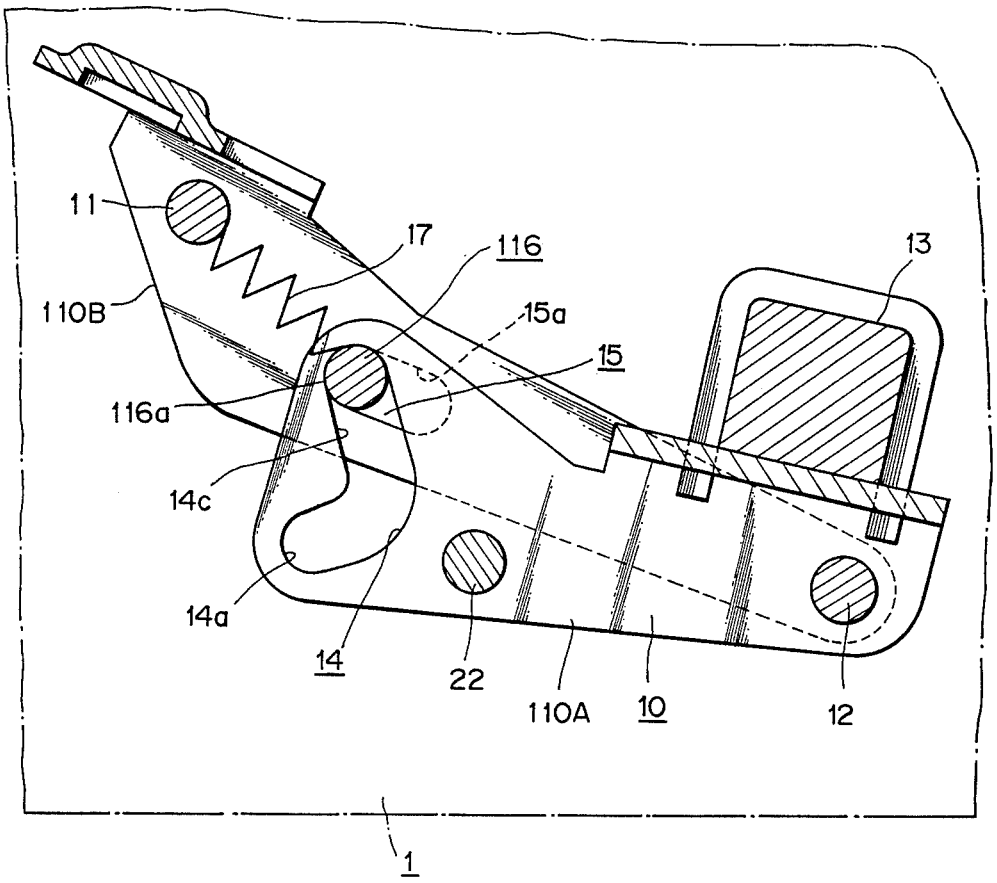
FIG. 8 is an enlarged cross-sectional view of the first circuit breaker shown in FIG. 7.

FIG. 7 is a longitudinal sectional view of a circuit breaker of the first embodiment of the present invention. FIG. 8 is an enlarged longitudinal sectional view of a major portion of the circuit breaker shown in FIG. 7.

Figure 1:
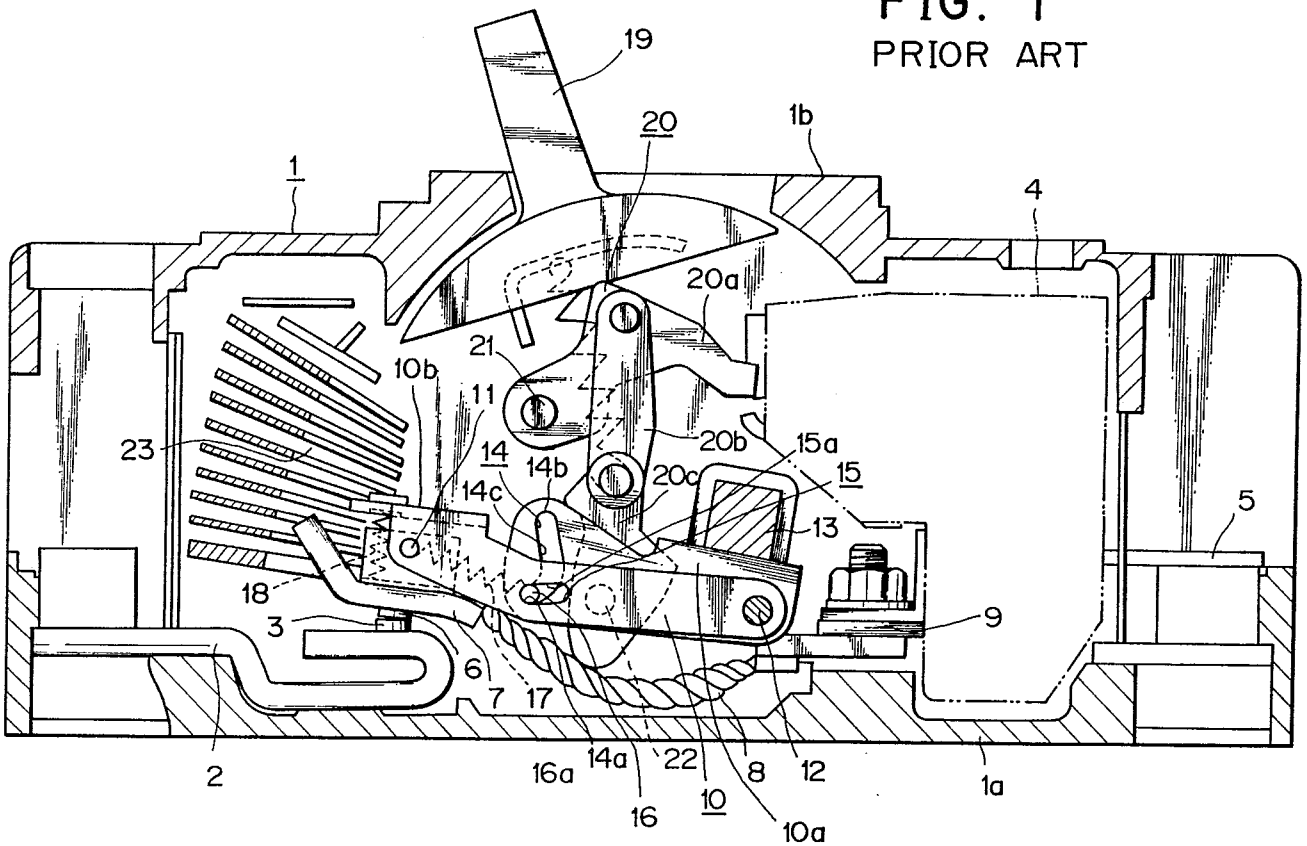
FIG. 1 PRIOR ART
FIG. 1 is a cross-sectional view of a conventional circuit breaker.
Figure 2:
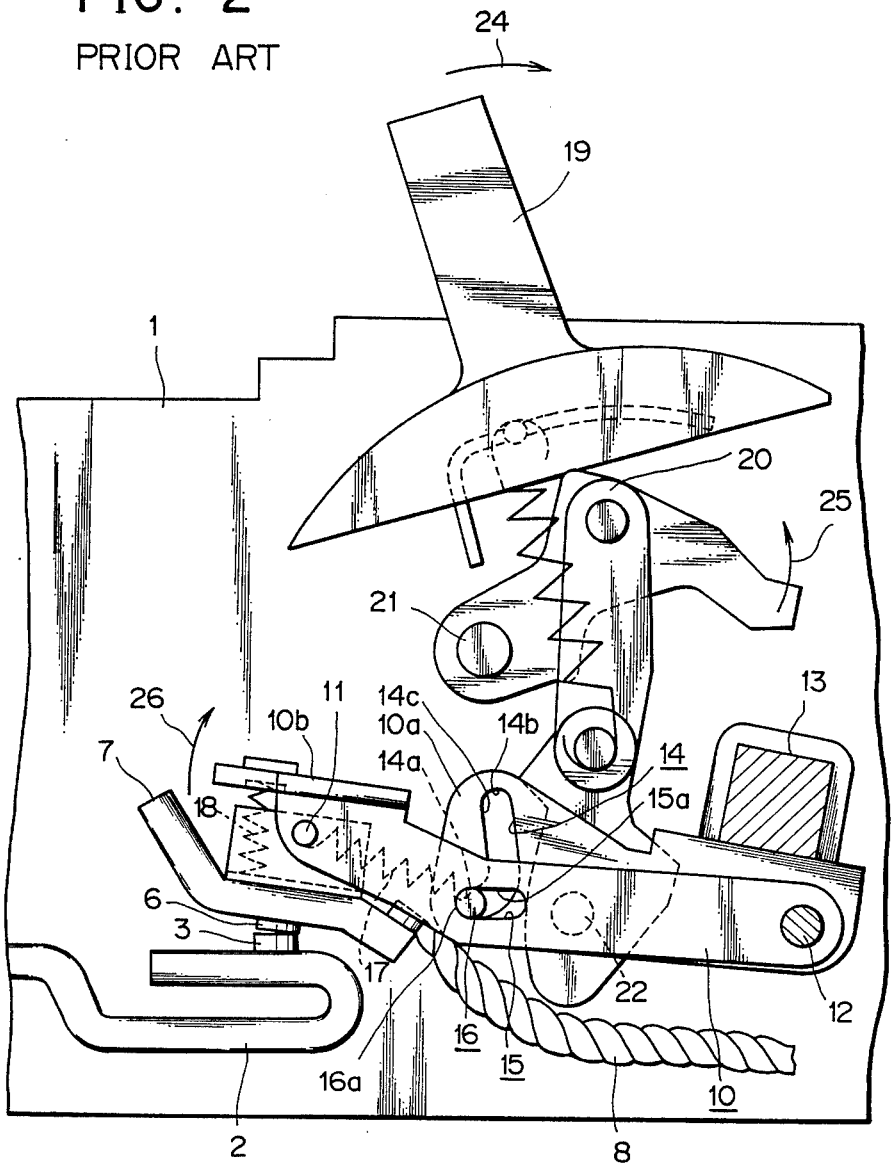
FIG. 2 PRIOR ART
FIG. 2 is an enlarged cross-sectional view of the circuit breaker shown in FIG. 1, illustrating the ON state.
Figure 3:
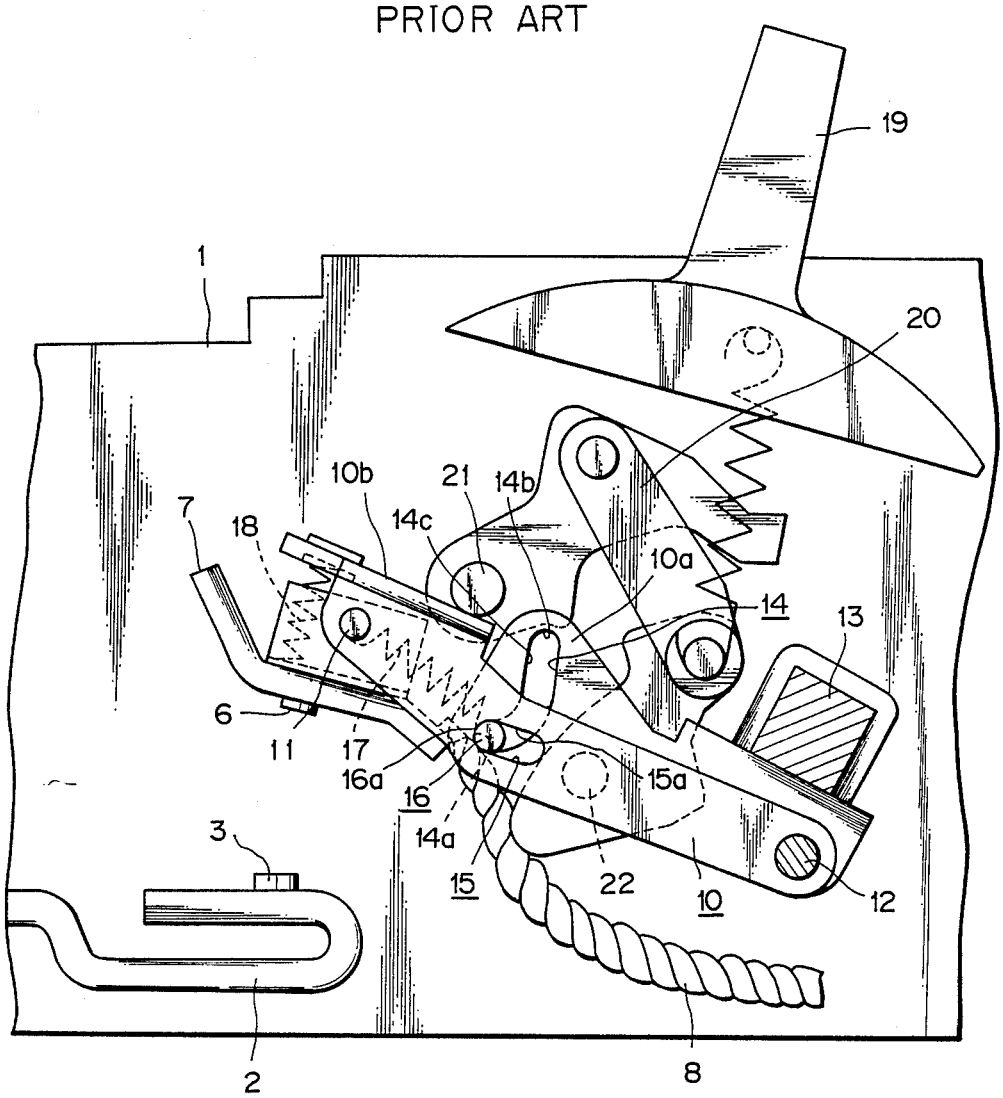
FIG. 3 PRIOR ART
FIG. 3 is an enlarged cross-sectional view of the circuit breaker shown in FIG. 1, illustrating the OFF state.
Figure 4:
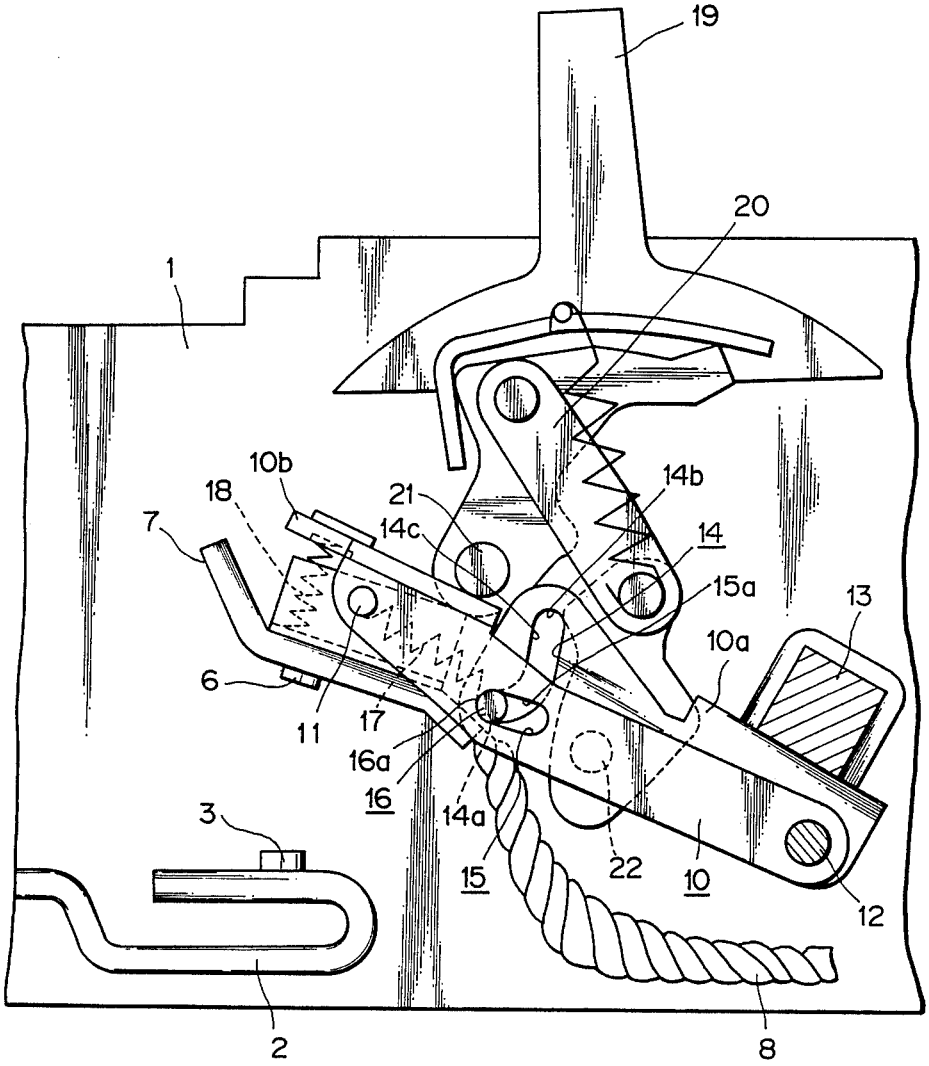
FIG. 4 PRIOR ART
FIG. 4 is an enlarged cross-sectional view of the circuit breaker shown in FIG. 1, illustrating the trip state.
Figure 5:
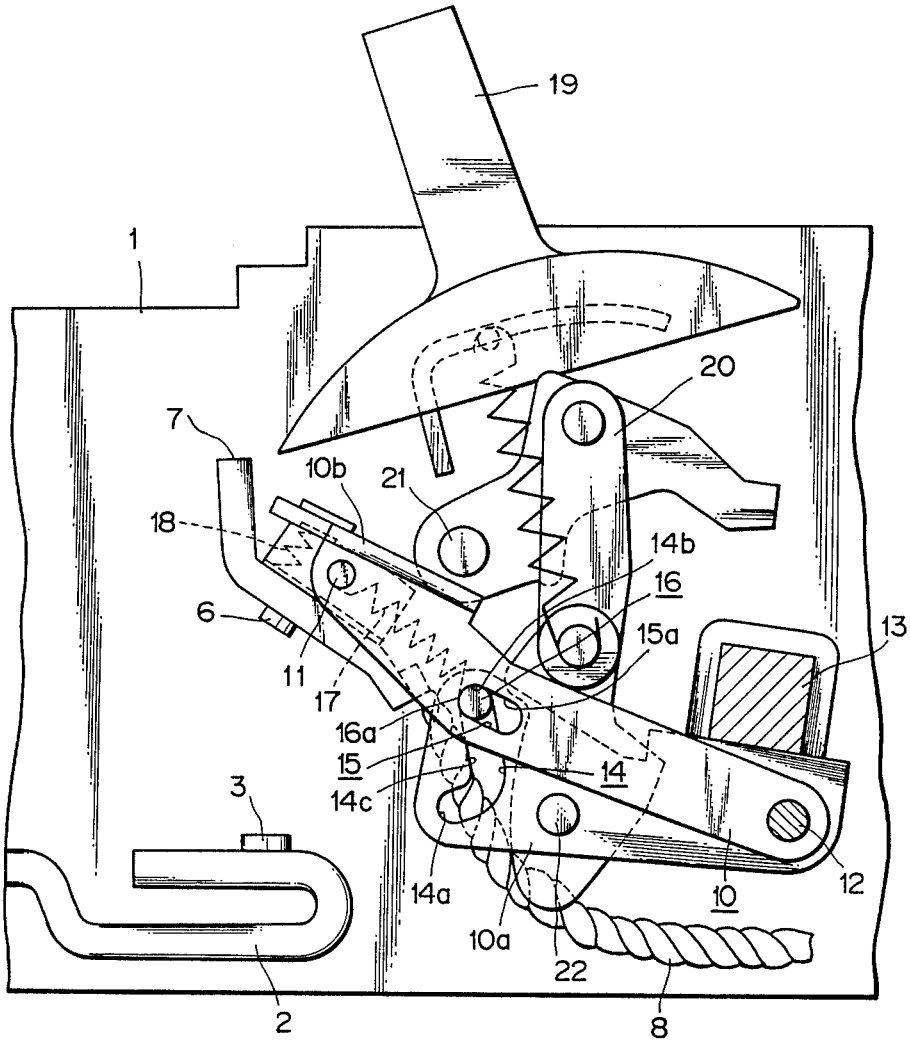
FIG. 5 PRIOR ART
FIG. 5 is an enlarged cross-sectional view of the circuit breaker shown in FIG. 1, illustrating the electromagnetic reaction state.
Figure 6:
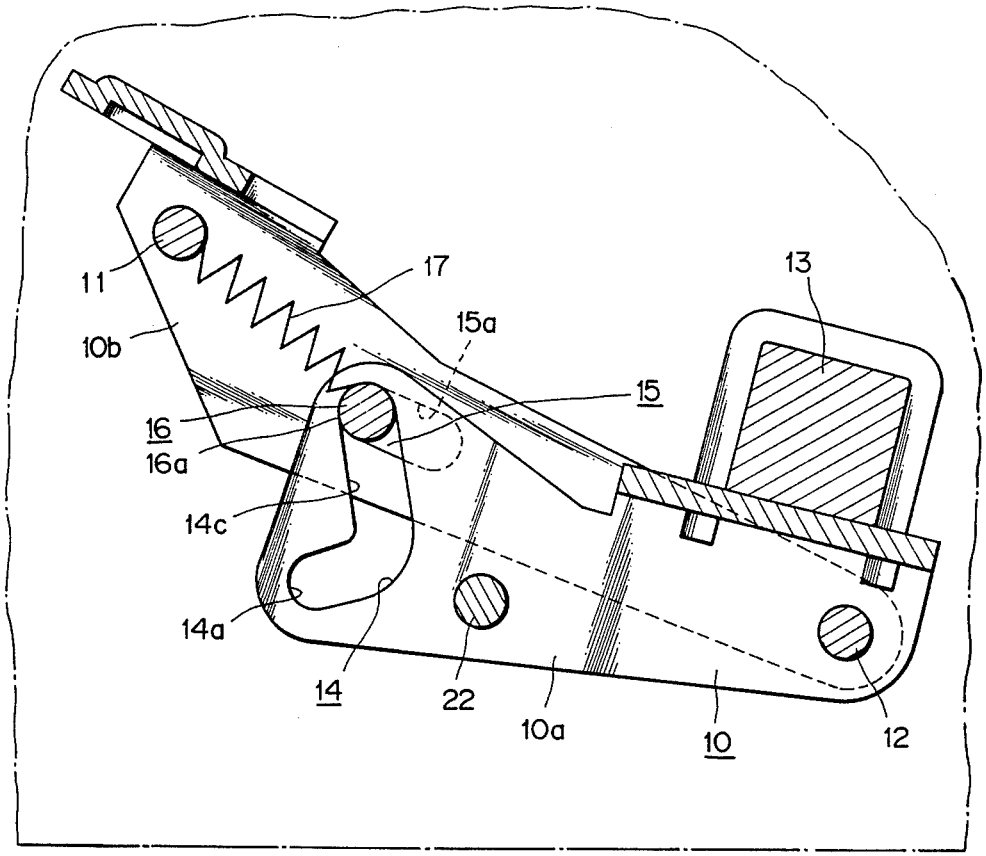
FIG. 6 is an enlarged cross-sectional view of the major portion of the circuit breaker shown in FIG. 1.

In these drawings, as the same numerals are used for the same or similar members as the components of the circuit breaker shown in FIG. 1, an explanation thereof is not given.

As is apparent from FIG. 8, the construction of the most part of the circuit breaker of the first embodiment shown in FIG. 7 is identical to that of the conventional circuit breaker shown in FIG. 1.

In FIGS. 7 and 8, 110A designates the first contact arm, the entire surface of which has been coated with a solid-film lubricant; 110B is the second contact arm, the entire surface of which has also been coated with a solid-film lubricant; and 116 represents the second pin, the entire surface of which has also been coated with a solid-film lubricant.

This solid-film lubricant coating of the entire surface of the first contact arm 110A, the second contact arm 110B and the second pin 116 presents the same effect as the low-frictional treatment of the pin sliding surface **14*c* of the guide hole 14 of the first contact arm 110A, the pin sliding surface 15*a* of the long hole 15 of the second contact arm 110B, and the contact surface 116*a* of the second pin 116. Accordingly, the first circuit breaker of the present invention has the advantage that both the pin sliding surfaces 14*c* and 15*a* of the guide hole 14 and the long hole 15, and the contact surface 116*a* of the second pin 116** have little frictional resistance, ensuring high-speed breaker operation and little reset load after the opening of the circuit breaker contacts.

OPERATION OF FIRST CIRCUIT BREAKER

The ON/OFF operation and trip operation of the circuit breaker of the first embodiment shown in FIGS. 7 and 8 are basically the same as those of the aforementioned conventional circuit breaker, and therefore an explanation thereof is omitted.

Although the first embodiment of the present invention has disclosed and described the first and second contact arms 110A, 110B and the second pin 116 whose entire surfaces are surface-treated, it is to be understood that the invention is not limited thereto but other embodiments and modifications of the invention are possible. For example, the similar effect may be obtained by performing low-friction treatment on each of at least the pin sliding surface **14*c* of the guide hole 14 of the first contact arm 110A, at least the pin sliding surface 15*a* of the long hole 15 of the second contact arm 110B, and at least the contact surface 116*a* of the second pin 116** (see FIG. 8).

According to the circuit breaker of the first embodiment, as described above, performing a single means, that is, the low-friction treatment, on both the pin sliding surfaces of the guide hole and the long hole and on the contact surface of the second pin can improve the repulsion speed to open the circuit breaker contacts as well as reduce the resetting load of the second pin in the guide hole after the opening of the circuit breaker contacts, thereby enabling an improvement in the circuit breaker performance at a low cost.

Arrangement of Second Circuit Breaker

The circuit breaker of the second embodiment of the present invention will be described in detail with reference to FIG. 9. The same numerals are used for the same or similar components as those of the circuit breaker of the first embodiment shown in FIGS. 7 and 8 and therefore an explanation thereof is not given.

Figure 9:
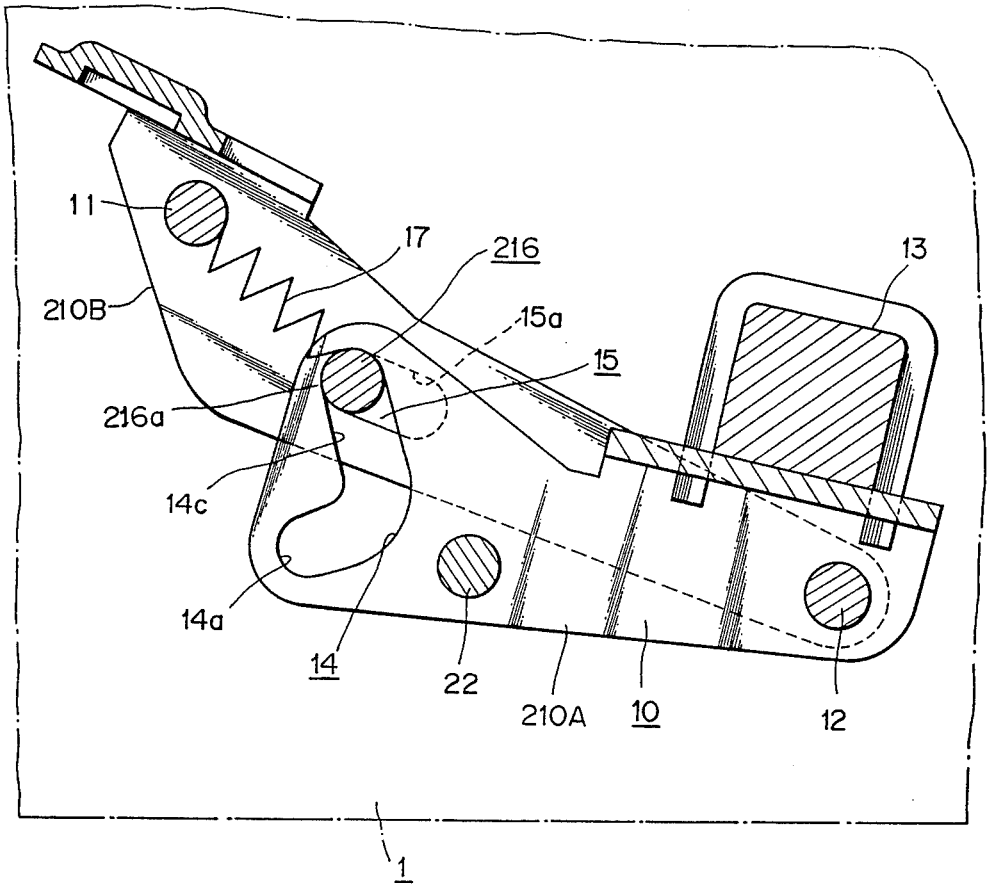
FIG. 9 is an enlarged cross-sectional view of the second circuit breaker.

In FIG. 9, reference numeral 210A designates a first contact arm plated over the entire surface with metal such as nickel which is of higher melting point than copper; 210B represents a second contact arm plated over the entire surface with metal such as nickel which is of higher melting point than copper; and 216 is a second pin plated over the entire surface with metal such as nickel of higher melting point than copper.

Plating the entire surfaces of the first contact arm 210A, the second contact arm 210B and the second pin 216 with metal of higher melting point than copper has the same effect as surface treatment for forming a surface exempt from attachment of molten metals resulting from arcing, on the pin sliding surface **14*c* of the guide hole 14 of the first contact arm 210A, the pin sliding surface 15*a* of the long hole 15 of the second contact arm 210B and the contact surface 216*a* of the second pin 216. Therefore, molten metals resulting from arcing at the time of opening of the circuit breaker contacts can not hold on both the pin sliding surfaces 14*c*, 15*a* of the guide hole 14 and the long hole 15 and the contact surface 216*a* of the second pin 216, thus ensuring smooth movement of the second pin 216**.

The ON/OFF and trip operations of the circuit breaker of the second embodiment described above are identical to those of the circuit breaker of the first embodiment shown in FIGS. 7 and 8 and therefore an explanation thereof is not given.

In the second embodiment described above, there were disclosed the first and second contact arms 210A, 210B and the second pin 216 plated with metal of higher melting point than copper, but the first and second contact arms 210A, 210B and the second pin 216 may be produced of iron or stainless metal and surface-treated by nitriding.

In the second embodiment, there were described the first and second contact arms 210A, 210B and the second pin 216 surface-treated over the entire surfaces, but at least the pin sliding surface **14*c* of the guide hole 14 of the first contact arm 210A, at least the pin sliding surface 15*a* of the long hole 15 of the second contact arm 210B, and at least the contact surface 216*a* of the second pin 216** may be plated with metal of higher melting point than copper or nitrided to obtain a similar effect.

According to the circuit breaker of the second embodiment, as aforementioned, performing a simple means that is, surface treatment, to form a surface exempt from attachment of molten metal resulting from arcing, on both the pin sliding surfaces of the guide hole and the long hole and the contact surface of the second pin can prevent attachment of molten metal resulting from arcing when the circuit breaker contacts are opened. Accordingly, the second pin moves smoothly, thus enabling the stabilization of the circuit breaker performance at a low cost.

Arrangement of Third Circuit Breaker

Next, the circuit breaker of the third embodiment will be explained by referring to FIG. 10.

The same numerals are used for the same or similar parts as those of the first embodiment shown in FIGS. 7 and 8, and therefore, an explanation thereof is omitted.

Figure 10:
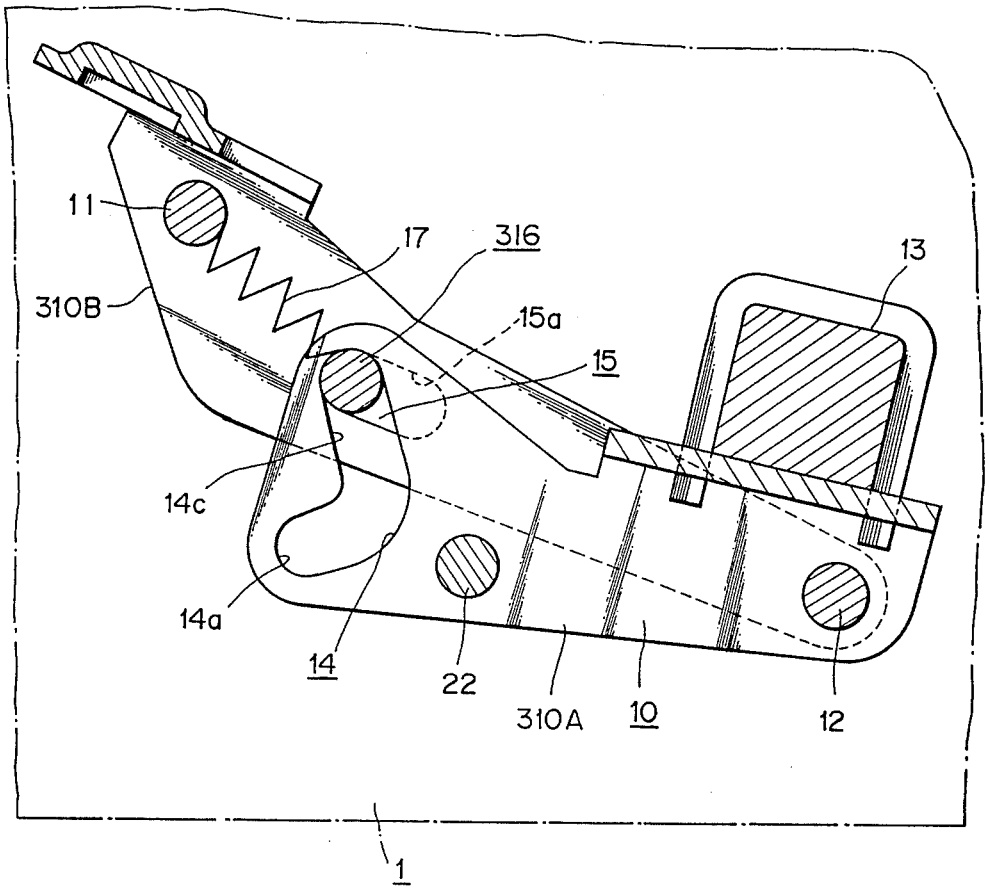
FIG. 10 is an enlarged cross-sectional view of the third circuit breaker.

In FIG. 10, 310 designates a first contact arm produced of iron or stainless metal and soft-nitrided over the entire surface; and 310B indicates a second contact arm produced of iron or stainless metal and soft-nitrided over the entire surface. Inasmuch as the second pin 316 is commonly produced of iron or stainless metal and quenched over the entire surface, its hardness is lower than that of the first and second contact arms 310A, 310B that are soft-nitrided.

Soft-nitriding the entire surface of the first contact arm 310A and the second contact arm 310B as described above has the same effect as the hardening treatment of the pin sliding surface **14*c* of the guide hole 14 of the first contact arm 310A and the pin sliding surface 15*a* of the long hole 15 of the second contact arm 310B which are thus provided with greater hardness than the second pin 316. Accordingly, both the pin sliding surfaces 14*c*, 15*a* will not be subjected to indentation if it receives impacts of the opening and closing of the circuit breaker contacts through the second pin 16. The movement of the second pin 316**, therefore, will not be disturbed.

As the ON/OFF and trip operations of the circuit breaker of the third embodiment described above are identical to those of the circuit breaker of the first embodiment, an explanation thereof is omitted.

In the third embodiment, there were indicated the soft-nitrided first and second contact arms 310A, 310B having greater hardness than the second pin 316, but the first and second contact arms 310A, 310B may be surface-treated by carburizing to provide higher hardness than the second pin 316. For example, iron or stainless metal surfaces are carburized to the depth of 0.1 mm or more.

In the third embodiment, there were described the first and second contact arms 310A, 310B surface-hardened over the entire surface. The similar hardness may be obtained by surface-hardening at least the pin sliding surface **14*c* of the guide hole 14 of the first contact arm 310A and at least the pin sliding surface 15*a* of the long hole 15 of the second contact arm 310B to greater hardness than the second pin 316**.

According to the circuit breaker of the third embodiment, as described above, performing a simple means to increase the surface hardness of both the pin sliding surfaces of the guide hole and the long hole more than the surface hardness of the second pin can prevent the second pin from forming indentation in both the pin sliding surfaces, thereby ensuring smooth movement of the second pin and stabilization of contact breaker performance at a low cost.

What is claimed is:

1. A circuit breaker wherein, in limiting a current by separating a movable contact arm 7 under electromagnetic repulsion caused by a flow of high currents regardless of an interrupting operation of an automatic tripping device 4, a contact arm 10 holding said movable contact arm 7 is divided into a first contact arm 310A and a second contact arm 310B both rotatably supported, and has a guide hole 14 provided on said first contact arm 310A in connection with a switching mechanism 20 and extending in a direction the circuit breaker contacts are opened and closed, a long hole 15 provided on said second contact arm 310B supporting said movable contact arm 7 by a first pin 11 and extending in another direction said long hole 15 intersects said guide hole 14, a second pin 316 engaged in both said long hole 15 and said guide hole 14, and a spring 17 which is pulling said second pin 316; whereby at least the pin sliding surface **14*c* of said guide hole 14 of said first contact arm 310A, and at least the pin sliding surface 15*a* of said long hole 15 of said second contact arm 310B are surface-treated to provide both the sliding surfaces 14*c*, 15*a* with greater hardness than said second pin 316**.

2. A circuit breaker as claimed in claim 1, wherein the surface-hardening treatment is a soft-nitriding treatment.

3. A circuit breaker as claimed in claim 1, wherein the surface-hardening treatment is a carburizing treatment.

* * * * *